US005571985A

United States Patent [19]

Ritter et al.

[11] Patent Number: 5,571,985

[45] Date of Patent: Nov. 5, 1996

[54] SEQUENTIAL BLASTING SYSTEM

[75] Inventors: Heinz Ritter, Schongau; Wolf Steinbichler, Bad Feilnbach, both of Germany

[73] Assignee: Euro-Matsushita Electric Works AG., Holzkirchen, Germany

[21] Appl. No.: 428,300

[22] Filed: Apr. 25, 1995

[30] Foreign Application Priority Data

May 2, 1994 [DE] Germany ..... 44 15 388.0

[51] Int. Cl.[6] ..... F42D 1/055

[52] U.S. Cl. ..... 102/217; 102/218; 361/249; 361/251

[58] Field of Search ..... 102/217, 218, 102/206; 361/249, 251

[56] References Cited

U.S. PATENT DOCUMENTS

| | | | |
|---|---|---|---|
| 3,099,962 | 8/1963 | Smith | 102/217 |
| 3,468,255 | 9/1969 | Stryker | 102/217 |
| 3,559,582 | 2/1971 | Hrzek | 102/217 |
| 3,808,459 | 4/1974 | Guimier et al. | 307/224 |
| 3,823,344 | 7/1974 | Havas | 102/217 |
| 3,892,182 | 7/1975 | Covarrubias et al. | 102/217 |
| 3,895,265 | 7/1975 | Watrous | 102/217 |
| 4,099,467 | 7/1978 | MacKellar et al. | 102/217 |
| 4,489,655 | 12/1984 | Molnar | 102/217 |
| 4,610,203 | 9/1986 | Bock | 102/217 |
| 4,760,791 | 8/1988 | Bock | 102/200 |

FOREIGN PATENT DOCUMENTS

| | | |
|---|---|---|
| 1287495 | 1/1969 | Germany . |
| 2356875 | 5/1975 | Germany . |
| 728367 | 11/1973 | South Africa . |
| 728368 | 11/1973 | South Africa . |

*Primary Examiner*—Michael J. Carone
*Assistant Examiner*—Christopher K. Montgomery
*Attorney, Agent, or Firm*—Foley & Lardner

[57] ABSTRACT

A sequential blasting system for use in particular in mining comprises a plurality of detonator stages S1, S2, . . . , each of which contains a series circuit consisting of a thyristor T and a detonator means ZE, said series circuit being interposed between two supply leads A, O; B, 0. The signal voltage for the thyristor T in each stage is derived solely from the switching state of the thyristor T of the preceding stage. This causes activation to be transferred from stage to stage independently of the detonator means ZE, in particular irrespectively of whether or not a detonator has been attached and whether or not this detonator becomes highly resistive or not as it should upon being activated. This eliminates the errors that have occurred in known circuits. Upon firing the blasting system, such errors can cause the detonation to occur not only at the first detonator stage, but simultaneously at a location where a detonator is missing as well. In other cases, such errors terminate the detonating sequence at the site of an improperly functioning detonator and induce impermissible delays and thus considerably shorten the length of time between the electrical sequence and the blast, thus causing undesirable changes in the shock wave caused by the blasting sequence.

19 Claims, 3 Drawing Sheets

SEQUENTIAL BLASTING SYSTEM

BACKGROUND OF THE INVENTION

This invention relates to a sequential blasting system including a plurality of sequentially triggered detonator stages, each having an explosive charge. Blasting systems of this type are specifically used in mining. In a typical example, 100 or more boreholes are drilled into the working face, each hole being filled with an explosive charge together with its associated detonator and being closed by a plug. In order to guarantee efficient demolition, it is important that the charges be fired one after another in a predetermined sequence, with a typical delay time of 30 ms between successive ignitions.

U.S. Pat. No. 4,099,467 describes a sequential blasting system with a plurality of detonator stages to be triggered in succession, wherein each of said detonator stages includes a thyristor and detonator means for detonating at least one explosive charge, said detonator means being connected in series with the output circuit of said semiconductor switch, and the resultant series circuits being connected in parallel between supply leads attached to a power source. The gate of the thyristor is connected to the tap of a voltage divider, which includes the detonator of the preceding stage, respectively. When the preceding detonator is triggered, its resistance changes from an initially low value effectively to infinity, thereby rendering the thyristor of the following stage conductive. The next current pulse activates the series detonator.

Every detonator is connected in parallel with a melting fuse provided to ensure that the change in resistance that is required to trigger the next stage and thus continue to trigger the sequential blasting system occurs even in the event that some location does not have a detonator. This melting fuse, however, constitutes a shunt and as such increases the current requirements considerably.

Another difficulty is that such a melting fuse constitutes an additional, separate component that must be inserted into every detonation stage. If the fuse in a printed circuit is realised by a thin segment of the PCB track, close tolerances must be observed when manufacturing the printed circuit, thus causing a cost increase.

If a detonator is attached, but defective in the sense that, although it fires, it does not do so immediately, but rather when the associated explosive charge becomes highly resistive (typically between 0.5 and 1.5 s later), this results in an exceedingly long delay within the sequential blasting system so that the shock wave at the working face cannot be propagated in the programmed manner. This substantially reduces the reliability of the blasting system, since the interval between the electrical sequence and the blast is shortened considerably.

The sequential blasting system known from U.S. Pat. No. 4,760,791 is plagued by similar problems. In this case, each detonator is connected in parallel with a transistor which conducts current even if a detonator should be missing at this site, thus preventing the blasting sequence from being interrupted by a missing detonator at this location. The parallel circuit consisting of the detonator and transistor is also connected in series with a melting fuse which is intended to prevent a delay in pulse propagation until the time of actual detonation by an improperly functioning detonator, i.e. one that does not become highly resistive immediately. The difficulties described above also exist in the case of the known sequential blasting system.

A far more serious problem is the fact that another transistor is used in such a way that it is shorted when the circuit is functioning correctly in order to produce a short-circuit for the detonation pulse. Since this destroys the transistor, it is not possible to check the known sequential blasting system to ensure that it will function properly before actually being put to use. Likewise, it is not possible to reuse the electronic circuitry of the blasting system. Finally, there is a danger that due to the considerable currents involved, the base solder sites that are not very sturdy to begin with will melt even before the detonator has been triggered.

Moreover, it is necessary to insert a separate activating element at the beginning of the blasting system, thus making it impossible to make the desired length of blasting system simply by cutting off sections or by joining additional sections to the end.

German Auslegeschrift 2,356,875 describes another sequential blasting system in which every detonator stage contains an oscillator, a frequency divider and two driver stages in addition to the actual detonator itself. The triggering pulse that arrives from the preceding detonator stage activates the first driver stage which in turn trips a switch to actuate the oscillator, the frequency divider and the second driver stage. The output of the frequency divider supplies the triggering signal for the next successive detonator stage in the blasting system, while the second driver stage actuates another switch that activates the detonator. Furthermore, every detonator stage also contains a capacitor to store the total energy required for detonation.

In this case, pulse propagation is independent of the presence and proper functioning of the detonator. This, however, necessitates an unreasonable amount of circuitry for practical sequential blasting systems.

German Auslegeschrift 1,287,495 discloses a sequential blasting system with a plurality of detonator stages to be triggered in succession, wherein each detonator stage includes a semiconductor switch and detonator means for detonating at least one explosive charge. The detonator means are connected in series with the output circuit of the semiconductor switch, and the resultant series circuits are connected in parallel between supply leads connected to a power source. The control input of the semiconductor switch of each detonator stage is connected to the junction between the semiconductor switch and the detonator means of the respective preceding detonator stage.

In this system, the propagation of the control signal from one detonator stage to the next is effected solely by the change in the switching stage of the semiconductor switch. This means that the sequential blasting system will remain functional even if individual detonators are missing or do not become highly resistive as they should. Since every semiconductor switch can become conductive and can activate the associated detonator means, when the semiconductor switch of the respective preceding stage has been triggered, the predetermined blasting sequence will be necessarily observed. The fact that the blasting system has been improperly assembled cannot cause the system to start detonating at two different locations simultaneously when the power source is switched on.

The known blasting system, however, requires at least one capacitor in each detonator stage to pass the triggering pulse from one detonator stage to the next. Due to the presence of such capacitors, the known circuit may not be fully integrated.

Moreover, this circuit again requires a separate circuit element connected to the input of the first detonator stage in order to initiate the blasting sequence, so that the system may not be elongated or shortened as desired—at least not at the end of the first detonator stage.

SUMMARY OF THE INVENTION

It is an object of the invention to provide a sequential blasting system which, on the one hand, has the advantage that it functions properly even if at individual locations a detonator is missing or faulty, particularly in that it does not become highly resistive immediately upon triggering, and which, on the other hand, permits the system to be manufactured in integrated circuit technology.

This object is accomplished by a sequential blasting system including a plurality of detonator stages to be triggered in succession, each detonator stage including a semiconductor switch and detonator means for detonating at least one explosive charge, the detonator means being connected in series with the output circuit of the semiconductor switch, the resultant series circuits being connected in parallel between supply leads connected to a power source, the control input of the semiconductor switch of each detonator stage being connected to the junction between the semiconductor switch and the detonator means of the respective preceding detonator stage, wherein the supply leads constitute a pair of channels which are alternately fed by the power source with pulses, successive detonator stages being alternately connected to the one and the other channel, and wherein each pulse supplied by the power source on one channel has an initial interval of lower voltage which overlaps the respective preceding pulse supplied on the other channel.

This sequential blasting system requires but an inexpensive circuit without capacitors and may therefore be readily integrated; it yet fulfills all requirements concerning the safety of operation even if improperly assembled or provided with faulty detonators.

The same object is accomplished by a sequential blasting system including a plurality of detonator stages to be triggered in succession, each detonator stage including a semiconductor switch and detonator means for detonating at least one explosive charge, the detonator means being connected in series with the output circuit of the semiconductor switch, the resultant series circuits being connected in parallel between supply leads connected to a power source, the semiconductor switch of each detonator stage being constituted by the voltage of a capacitor which is connected to be charged via the semiconductor switch of the respective preceding detonator stage, wherein the supply leads constitute a pair of channels, successive detonator stages being alternately connected to the one and the other channel, and wherein one common capacitor is provided for each pair of successive detonator stages, the capacitor being connected to be charged via the semiconductor switch of the detonator stage preceding the pair of detonator stages to a first value, and to be charged via the semiconductor switch of the first detonator stage of the pair to a second value higher than the first value.

In this sequential blasting system, the same capacitor is used for each pair of successive detonator stages so that the overall system requires only half as many capacitors as the prior art, without being less safe in operation.

It is another object of the present invention to provide a sequential blasting system which again exhibits the advantage of the known circuit in that it functions properly even if at individual locations a detonator is missing or faulty, but which does not require an individual initiating circuit element.

This object is met by a sequential blasting system including a plurality of detonator stages to be triggered in succession, each detonator stage including a semiconductor switch and detonator means for detonating at least one explosive charge, the detonator means being connected in series with the output circuit of the semiconductor switch, and a first resistor connected in parallel to the detonator means, the series circuits, which are thus formed each by a detonator means and a semiconductor switch, being connected in parallel between supply leads connected to a power source, the control signal for the semiconductor switch of each detonator stage being constituted by the voltage of a capacitor which is adapted to be charged via the semiconductor switch of the respective preceding detonator stage, wherein the capacitor is connected in series with a second resistor between the supply leads, wherein the junction between the capacitor and the second resistor is connected via a diode to the junction between the semiconductor switch and the first resistor of the respective preceding detonator stage, and wherein the first and second resistors are so dimensioned that the capacitor is charged to a voltage required to turn on the semiconductor switch only if the semiconductor switch of the preceding detonator stage is conductive.

In this sequential blasting system, all detonator stages or pairs of detonator stages may be identically designed. Nevertheless, the blasting sequence will start at the first detonator stage of the system, when the power source is switched on, without requiring specific measures for the initial ignition.

Preferably, every detonator means contains two detonators connected in series. This effectively prevents excessive consumption of current should a detonator not immediately become highly resistive when triggered.

According to another embodiment of the invention, the power source generates a direct voltage between the supply leads and that all detonator stages are connected in parallel. A simple, untriggered power source is sufficient to operate this sequential blasting system.

For providing the first stage in the blasting sequence with a starting pulse, the control input and the output circuit of the semiconductor switch may be connected with the same channel within the first detonator stage in the blasting sequence. Alternatively, the power source supplies an overvoltage pulse to trigger the first detonator stage in the blasting sequence, or the control input of the semiconductor switch in the first detonator stage in the blasting sequence is connected to the respective channel across an RC element. In another alternative embodiment the control input of the semiconductor switch in the first detonator stage in the blasting sequence is connected with both channels and the power source generates a pulse in both channels to trigger the first detonator stage.

If each two detonator stages are combined to form a circuit element accommodated in a common housing and all circuit elements have the same construction, a blasting system for a desired number of detonations can simply and easily be produced by cutting the desired length off a longer or continuous section or by joining shorter sections to one another.

DETAILED DESCRIPTION OF PREFERRED EMBODIMENTS

Figure 1:
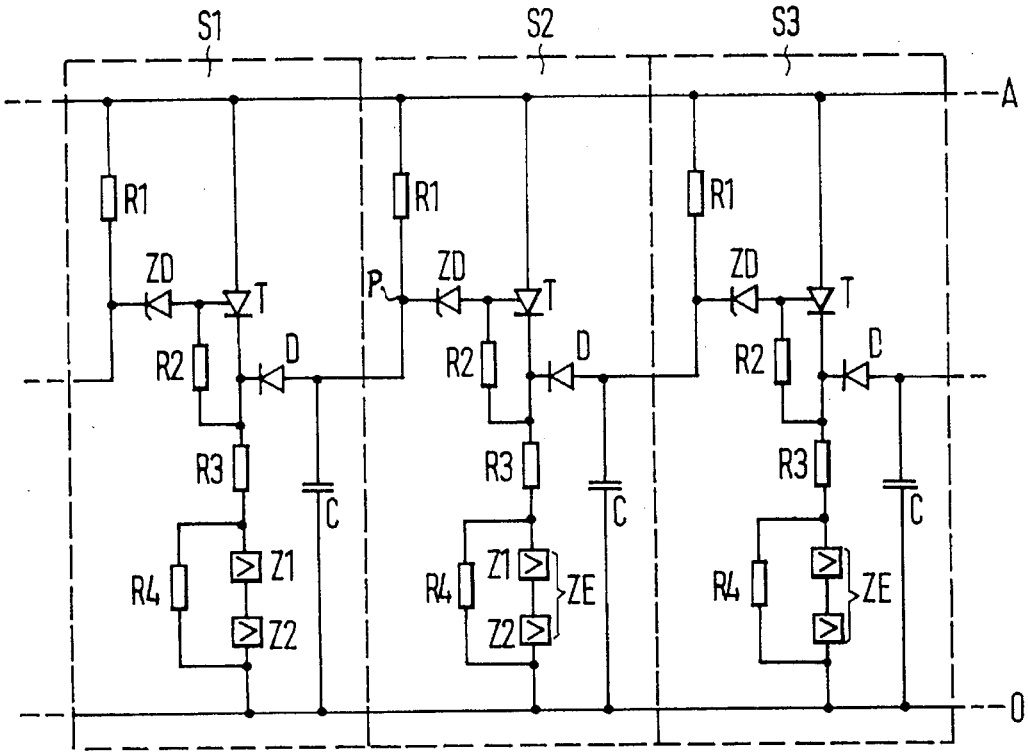
FIG. 1 shows part of a sequential blasting system according to a first embodiment.

In a sequential blasting system circuitry according to FIG. 1, the individual detonator stages S1, S2, . . . are connected in parallel and interposed between two supply leads A and O which are connected to a source of direct current (not shown) on the right side in FIG. 1. The direct current source generates an output voltage of 50 V in lead A with respect to the grounded lead O.

Every one of the identically built detonator stages S1, S2, . . . contains a series circuit interposed between the supply leads A, O. Each series circuit consists of a thyristor T and a detonation means ZE comprising two detonators Z1, Z2 connected in series. Each detonator Z1, Z2 serves to trigger an explosive charge (not shown). In the circuits described here, detonators are used which have a built-in delay of 0.5 to 1.5 s.

The gate of the thyristor T is connected across a Zener diode ZD (Zener voltage: 35 V) to the junction P between a resistor R1 (2,2 KΩ), whose other end is connected to the supply lead A, and a capacitor C (22 μF) which belongs to the preceding detonator stage S1 and whose other end is connected to supply lead O. The junction P is also connected across a diode D with the junction between the thyristor T and the detonator means ZE of the preceding detonator stage. A resistor R3 (100 Ω) is connected between the gate and cathode of the thyristor T. Another resistor R3 (5 Ω) is positioned between the junction of the cathodes of the thyristor T and the diode D on the one hand and the detonator means ZE on the other. A fourth resistor R4 (470 Ω) bridges the detonator means ZE.

The resistors R1 and R4 are dimensioned such that when a voltage of 50 V is applied to lead A the potential at the junction P is not sufficient to trigger the thyristor T of stage S2. Only when the thyristor T of the preceding stage S1 becomes conductive does the junction P achieve a potential (50 V minus the voltage drop at the thyristor T and the diode D), at which the resistor R1 can recharge the capacitor C to such a high value that the detonation voltage for the thyristor T of stage S2 is attained. Taking the Zener voltage (35 V) of the Zener diode ZD into consideration, this value amounts to approximately 15 V which is sufficient to trigger the thyristor T.

The delay with which the thyristor T of stage S2 becomes conductive after the thyristor T of stage S1 has been enabled depends on the time constant of the RC element formed by resistor R1 and capacitor C. Appropriately dimensioning these components allows the typically desired delay of 30 to 50 ms to be achieved.

As indicated by the description above, the propagation of the triggering pulse from one stage to the next with the predetermined delay time is independent of the detonator means ZE. This means that the circuit will operate properly even if it was forgotten to include a detonator means in one or more detonator stages.

The same applies if a detonator means is present, but does not function properly and does not become highly resistive immediately upon being triggered. In this case, the detonator would retain its very low original resistance until the actual explosive charge explodes (thus destroying the detonator). In practice, it has been found that a small percentage of all detonators demonstrate such behaviour.

If two detonators Z1, Z2 are connected in series as is assumed in FIG. 1, the probability that both detonators will exhibit such a malfunction is extremely small. This effectively prevents short-circuit current being tapped from the power source during the entire interval from the activation of the thyristor T to the detonation of the explosive charge (i.e. approx. 0.5 to 1.5 s). The resistor R3 is provided for the very rare event that both series detonators Z1, Z2 both become highly resistive at the same time.

In the sequential blasting system according to FIG. 1, all detonator stages S1, S2, . . . are built identically. It is therefore possible to make blasting systems with a desired number of detonator stages simply by cutting off the desired length from a longer length. In this case, the first stage (S1 in FIG. 1) in the blasting sequence lacks the capacitor C which is otherwise present in the preceding stage to generate the detonator voltage. The first stage S1 is detonated without delay when the supply voltage is applied to lead A across the Zener diode ZD and the resistor R3, since there are no circuit elements D, R3 and R4 from a preceding stage.

Figure 2:
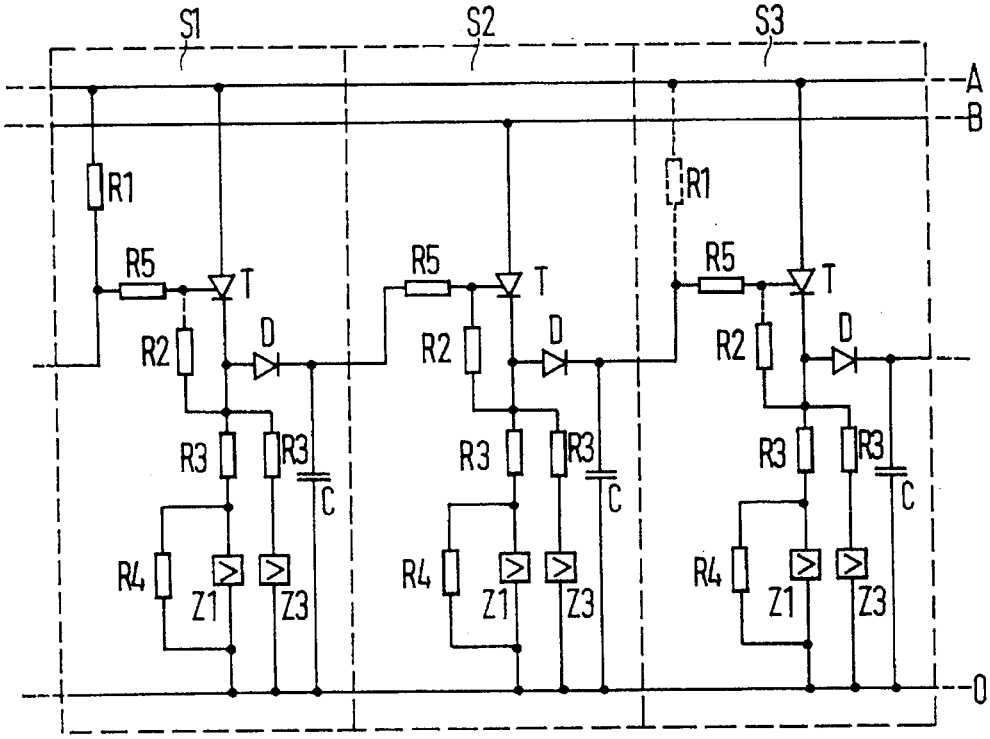
FIG. 2 shows a second embodiment similar to that of FIG. 1.

The circuit according to FIG. 2 differs from that according to FIG. 1 in that a power source is used which alternately supplies current pulses, which preferably do not overlap, to two channels connected to supply leads A and B. The detonator stages are alternately connected to the supply leads A and B.

In the circuit according to FIG. 2, the detonation delay from one stage to the next is thus predetermined by the current pulse source. The individual detonator stages S1, S2, . . . thus can do without an RC element, and the resistor R1 present in FIG. 1 can even be omitted. Furthermore, the Zener diode ZD in the circuit according to FIG. 2 has been replaced by a resistor R5 (1 KΩ).

Since in FIG. 2 every detonator stage is activated only when the thyristor T has been rendered conductive by applying a corresponding signal to its gate and a pulse is applied to the supply lead A or B, it is not necessary to provide a series circuit consisting of two detonators as the detonation means. Even if the individual detonator should not become highly resistive as it should upon being activated, the current consumption is limited to that brief time interval (e.g. 10 to 20 ms) during which the current pulse is applied to the supply lead A, B.

In the circuit according to FIG. 2, the parallel connection of two detonators Z1 and Z3 together with their respective dropping resistors R3 is shown as a variation. This parallel circuit merely constitutes a way of saving money. In such a case, both detonators are triggered simultaneously so that the correspondingly associated explosive charges detonate simultaneously as well. The resistor R3 makes it possible to enable thyristor T and charge capacitor C of the following detonator stage, even if the respective detonator Z1, Z3 should short-circuit.

Incidentally, the capacitor C (4.7 μF) only recharges when the thyristor T of the preceding detonator stage becomes conductive, similar to the situation in the circuit according to FIG. 1. When the capacitor C reaches a specific potential, the detonation voltage for the thyristor T is also attained, causing this to be triggered by the subsequent current pulse in the associated supply lead A, B.

In FIG. 2, a resistor R1 is depicted in the first detonator stage S1 which is connected with the same supply lead A as the thyristor T of the first detonator stage S1. This resistor R1, in conjunction with an appropriate overvoltage pulse (80~100 V / 1 ms) in supply lead A, serves to provide the initial detonation of the sequential blasting system.

If it is desirable to construct the blasting system with the same construction throughout, a resistor R1 which is connected with the same supply lead (A) can be provided in all detonator stages S1, S3, . . . . Such a resistor R1 (which is not necessary for the circuit to function properly) has been indicated by the dotted lines in FIG. 2 in detonator stage S3.

It is impossible for all successive stages to trigger on the basis of a pulse duration of 1 ms, since the associated capacitor C is only charged to approximately 5 V. Only the first stage S1, which contains no capacitor, can trigger on the basis of such a short pulse. This ensures that the blasting sequence will always start at the beginning of the sequential blasting system.

Figure 3:
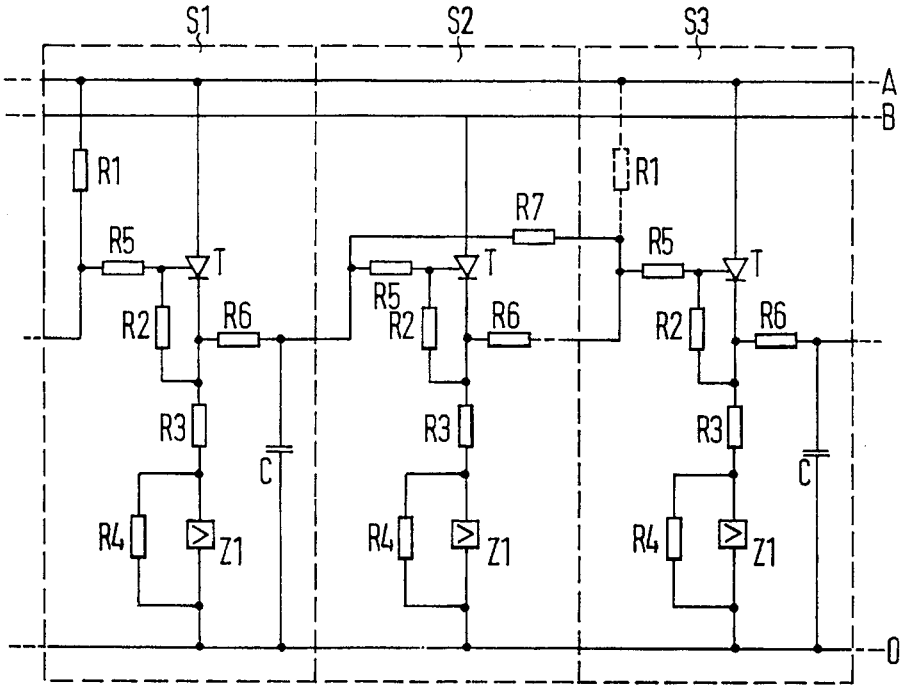
FIG. 3 illustrates a modification of the circuitry according to FIG. 2.

The circuit according to FIG. 3 is quite similar to that according to FIG. 2, except for the fact that a common capacitor is provided for two successive detonator stages. In FIG. 3, this is the capacitor C (4.7 μF) which is located in the detonator stage S1 and which serves to generate the control voltages for the thyristors T of detonator stages S1 and S3. Otherwise, the circuit according to FIG. 3 is identical to that according to FIG. 2, the diode D being replaced by a resistor R6 (2.2 KΩ).

The end of the capacitor C facing away from the supply lead O is connected across a resistor R5 (1 KΩ) with the gate of the thyristor T of stage S2 as illustrated in FIG. 2. The same electrode of the capacitor C is also attached across a resistor R7 (4.7 KΩ) and resistor R5 (1 KΩ) to the control electrode T of detonator stage S3.

If the resistor R1 is not provided, both series resistors R7 and R5 could also be combined to form one resistor (5.7 KΩ). The embodiment shown in FIG. 3 was selected for the reasons described above, i.e. that all elements in the blasting system be identical, the resistor R1 (5 KΩ) (indicated by dotted lines) in stage S3 again not being necessary for the circuit to function properly.

As soon as the thyristor T of detonator stage S1 becomes conductive, the capacitor C recharges via the resistor R6 to approximately 15 V. This value is sufficient to trigger the thyristor T of stage S2. If the thyristor T of stage S2 is triggered by the next current pulse in supply lead B, the capacitor C is recharged via resistor R2 (100 Ω) and resistor R5 (1 KΩ) to approximately 34 V which in consideration of resistors R7 and R5 is again sufficient to trigger the thyristor T of detonator stage S3 which in turn triggers as soon as the next pulse occurs in supply lead A.

Two detonator units connected in parallel could be provided in every detonator stage in the circuit according to FIG. 3 just as in FIG. 2. Likewise, the initial detonation of the first stage S1 can occur via the resistor R1 provided there and an initial overvoltage pulse in supply lead A.

The circuit according to FIG. 1 operates with a capacitor in order to attain the desired delay of 50 ms between the successive detonator stages. The time element consists of the resistor R1 and the capacitor C, and the switching threshold (35 V) is determined by the Zener diode ZD.

The circuits according to FIGS. 1 and 2 use a capacitor to propagate the switching pulse from one stage to the next and to store it in leads A and B during the gap between successive pulses (approx. 1 to 2 ms). This storage function is taken over by the thyristor itself in the other circuit according to FIG. 4.

Figure 4:
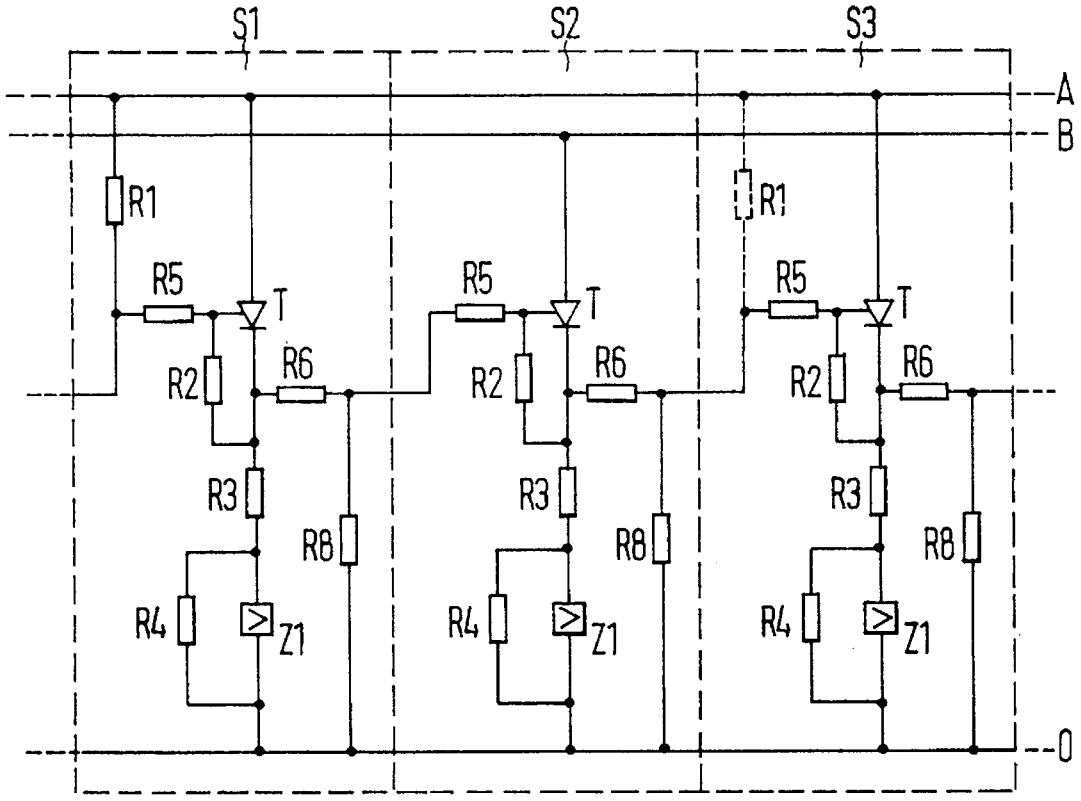
FIG. 4 shows another embodiment of a sequential blasting system.

The circuit according to FIG. 4 is identical to that according to FIG. 2, the diode in FIG. 2 being replaced by a resistor R6 (2.2 KΩ) similar to FIG. 3 and a resistor R8 (1KΩ) being provided instead of the capacitor C.

Figure 5:
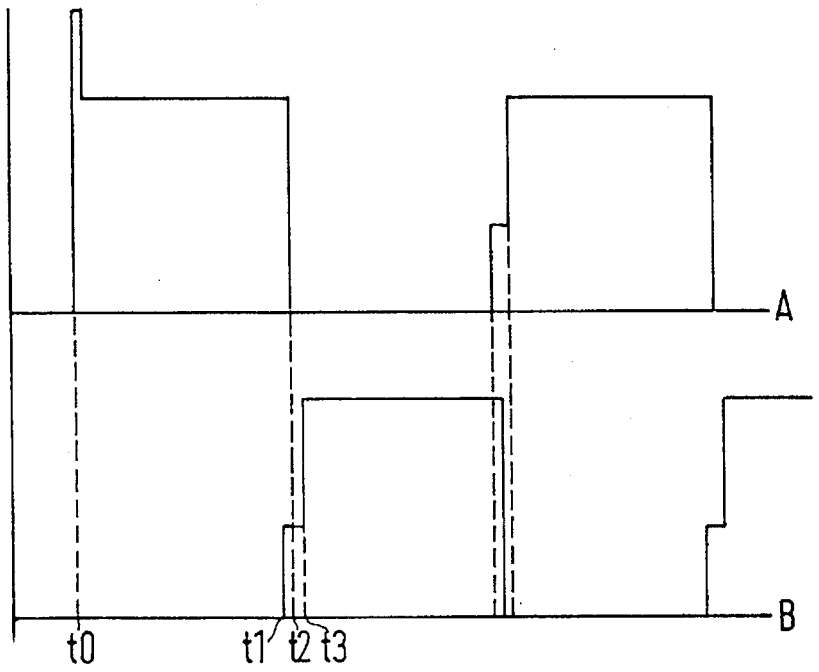
FIG. 5 is a pulse diagram of the current pulses produced by a power source to operate the blasting system according to FIG. 4.

Yet another distinction between the circuits according to FIGS. 2 and 3 is that the pulses supplied by the power source via supply leads A, B follow directly one after the other and every pulse according to FIG. 5 has an initial interval of reduced voltage which overlaps the preceding pulse in the other supply lead respectively.

During the time interval $t_0$~$t_2$ shown in FIG. 5, in which the full pulse (50 V) occurs in supply lead A, the thyristor T of detonator stage S1 is enabled. Prior to the end of this time interval, the initial interval (20 V) of reduced voltage of the next pulse in supply lead B occurs at time t1 so that thyristor T detonates stage S2. The voltage (20 V) applied to the cathode, however, is not sufficient to trigger the thyristor T of the next stage S3 which is actually loaded with the full voltage of the pulse in lead A. Only once the pulse in lead A has been switched off at time t2 does the pulse in lead B increase to full voltage (50 V) at time t3 so that the thyristor T of stage S2 can now be fully enabled and supply the voltage required to detonate the thyristor T of the next stage S3.

Similar to the circuits according to FIGS. 2 and 3, the circuit according to FIG. 4 also contains in stage S1 an additional resistor R1 (10 KΩ) which in conjunction with the first overvoltage pulse shown in FIG. 5 serves to initially detonate the sequential blasting system.

Here again, except in the first detonator stage S1, the same resistor R1 in the other stages is not necessary for the circuit to function properly and has therefore been depicted by dotted lines. It can be provided as described above to be able to construct the entire blasting system from identical units. Likewise, two detonators connected in parallel can be provided in the detonator stage in the circuit according to FIG. 4 as well.

Figure 6:
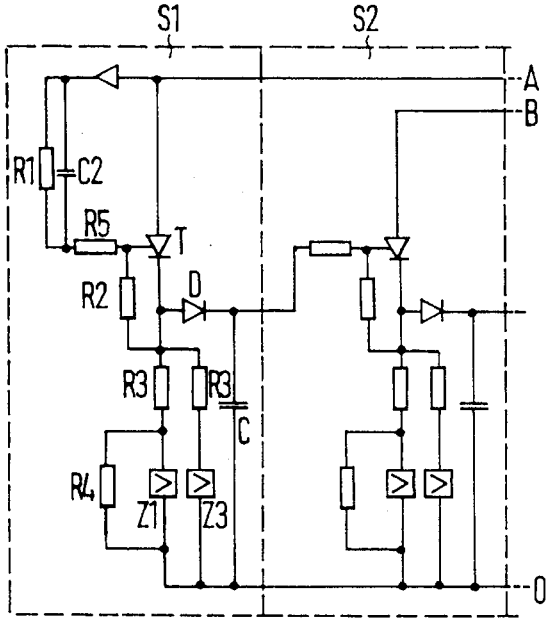
FIG. 6 shows an embodiment for the first detonator stage in the blasting sequence.

FIG. 6 illustrates one variation of the first detonator stage S1 of a sequential blasting system which is otherwise constructed the same as in FIG. 2. The same variation is also suitable for the circuits according to FIGS. 3 and 4.

In the circuit according to FIG. 6, the resistor R1 shown in FIG. 1 is replaced by a parallel circuit consisting of a resistor R1' (>100 KΩ) and a capacitor C2 (1 μF). This means that only the first pulse of 50 V applied to supply lead A will be capable of triggering the thyristor T of the first stage S1, even if the capacitor C2 is still empty. The resistor R1' causes the capacitor C2 to discharge so slowly that all other pulses in the supply lead A will no longer arrive at the gate of the thyristor T.

Hence, the first detonator stage S1 of the sequential blasting system has a special configuration in the circuit according to FIG. 6. Although this means that the blasting system starts to operate as soon as the pulse current source is actuated without requiring an initial overvoltage pulse, it is no longer possible to produce a properly functioning sequential blasting system merely by cutting a section off long, prefabricated blasting systems.

Figure 7:
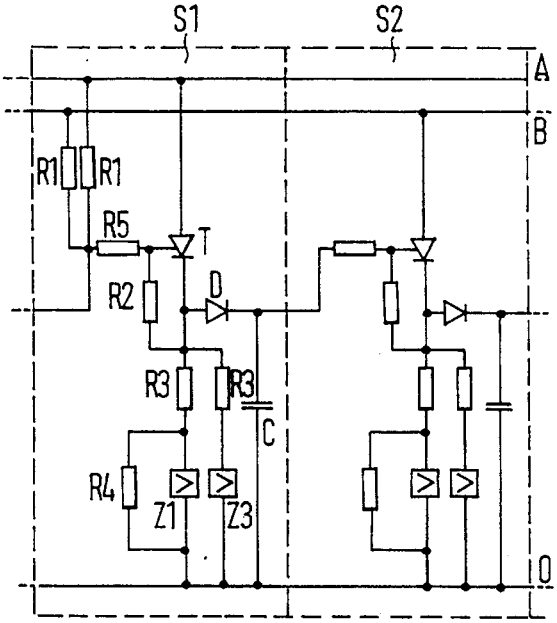
FIG. 7 shows a modification of the blasting system circuit according to FIG. 2 embodying another measure for triggering the first detonator stage.

Even in the circuit variation shown in FIG. 7, the thyristor T in the first stage S1 can be triggered without an initial overvoltage pulse. The circuit according to FIG. 6 presupposes that a current pulse will be generated briefly in both leads A, B for the initial detonation and will be combined via both resistors R1, R1" provided here (10 KΩ each). In this version it is again possible to construct the entire blasting system using identical units merely by cutting a section off a longer length of blasting system, assuming that the number of resistors R1, R1" is to be doubled in every (or in every other) detonator stage as indicated by the dotted lines in FIG. 7 for detonator stage S3.

In the blasting system circuits according to FIGS. 2 to 4, the even-numbered detonator stages are identical to one another as are the odd-numbered stages. To ensure that when cutting such a section off a longer length of sequential blasting system the right type of detonator stage forms the first stage of the system or when joining sections together that two identical detonator stages are not joined together, successive stages can be arranged in pairs in common housings (not shown).

The dimensions of the various circuit elements specified in parentheses in the description of the figures above are only representative of typical values in embodiments.

We claim:

1. A sequential blasting system including a plurality of detonator stages to be triggered in succession, each detonator stage including a series circuit of detonator means for detonating at least one explosive charge and a semiconductor switch having a control input terminal and a pair of output terminals, with a junction between said detonator means and said semiconductor switch, pulse generating means constituting first and second channels which are alternately supplied with electrical pulses, each pulse having a main interval of a given voltage and an initial interval of a voltage lower than said given voltage and overlapping the respective preceding pulse supplied to the other channel, said detonator stages being alternately connected to said first and second channels of said pulse generating means, and the control input of the semiconductor switch of each detonator stage being connected to the junction between the semiconductor switch and the detonator means of the respective preceding detonator stage.

2. The system of claim 1, wherein the control terminal and the output terminals of the semiconductor switch are connected with the same channel in the first detonator stage in the blasting sequence.

3. The system of claim 2, wherein said pulse generating means is adapted to supply an overvoltage pulse to trigger the first detonator stage in the blasting sequence.

4. The system of claim 2, wherein the control terminal of the semiconductor switch in the first detonator stage in the blasting sequence is connected to the respective channel across an RC element.

5. The system of claim 2, wherein the control terminal of the semiconductor switching the first detonator stage in the blasting sequence is connected with both channels and said pulse generating means generates a pulse on both channels to trigger said first detonator stage.

6. The system of claim 1, wherein pairs said of detonator stages are combined to form identical circuit units each accommodated in one housing.

7. The system of claim 1, wherein every detonator means contains two detonators connected in series.

8. The system of claim 1, wherein every detonator means contains two detonators connected in parallel.

9. A sequential blasting system including a plurality of detonator stages to be triggered in succession, each detonator stage including a series circuit of detonator means for detonating at least one explosive charge and a semiconductor switch having a control input terminal and a pair of output terminals, and pulse generating means constituting first and second channels which are alternately supplied with electrical pulses, wherein said detonator stages are alternately connected to said first and second channels of said pulse generating means, and a capacitor common to a pair of successive detonator stages and connected to be charged to a first voltage via the semiconductor switch of the respective detonator stage preceding said pair of detonator stages and to a second voltage higher than said first voltage via the semiconductor switch of the first one of the pair of detonator stages.

10. The system of claim 9, wherein said capacitor is connected with the control input of the semiconductor switch of the first one of said pair of successive detonator stages via a first resistance and to the control input of the semiconductor switch of the second one of said pair of detonator stages via a second resistance which is larger than said first resistance.

11. The system of claim 9, wherein the control terminal and the output terminals of the semiconductor switch are connected with the same channel in the first detonator stage in the blasting sequence.

12. The system of claim 11, wherein said pulse generating means is adapted to supply an overvoltage pulse to trigger the first detonator stage in the blasting sequence.

13. The system of claim 11, wherein the control terminal of the semiconductor switch in the first detonator stage in the blasting sequence is connected to the respective channel across an RC element.

14. The system of claim 11, wherein the control terminal of the semiconductor switch in the first detonator stage in the blasting sequence is connected with both channels and said pulse generating means generates a pulse on both channels to trigger said first detonator stage.

15. The system of claim 9, wherein pairs of said detonator stages are combined to form identical circuit units each accommodated in one housing.

16. The system of claim 9, wherein every detonator means contains two detonators connected in series.

17. The system of claim 9, wherein every detonator means contains two detonators connected in parallel.

18. A sequential blasting system including a plurality of detonator stages to be triggered in succession and being energised by a power source, each detonator stage including a series circuit of detonator means for detonating at least one explosive charge and a semiconductor switch having a control input terminal and a pair of output terminals, with a junction between said detonator means and said semiconductor switch, a first resistor connected in parallel with said detonator means, a capacitor adapted to be charged through said semiconductor switch when in its conductive state for providing a control signal to the control terminal of the semiconductor switch included in the respective subsequent detonator stage, a second resistor connected in series with the capacitor of the respective preceding detonating stage across said power source, and a diode interconnecting the junction between the capacitor and the second resistor with the junction between the semiconductor switch and the first resistor, said first and second resistors being dimensioned such that the capacitor is charged to a voltage required to turn on the semiconductor switch of the subsequent detonator stage only if the semiconductor switch is conductive.

19. The system of claim 18, wherein said power source is a d.c power source and all detonator stages are connected in parallel.

* * * * *